United States Patent [19]

Aanensen

[11] Patent Number: 4,602,697

[45] Date of Patent: Jul. 29, 1986

[54] ESCAPE MEANS FOR SEA-BASED CONSTRUCTION

[76] Inventor: Oscar Aanensen, Torvastad, Norway

[21] Appl. No.: 715,481

[22] Filed: Mar. 25, 1985

[30] Foreign Application Priority Data

Mar. 23, 1984 [NO] Norway ..... 841145

[51] Int. Cl.[4] ..... A62B 1/20

[52] U.S. Cl. ..... 182/48; 14/71.1; 193/25 R; 244/137 P

[58] Field of Search ..... 182/48, 49; 14/71.1, 14/71.5, 71.7; 193/25 R; 244/137 P

[56] References Cited

U.S. PATENT DOCUMENTS

| | | | |
|---|---|---|---|
| 2,641,785 | 6/1953 | Pitts | 14/71.1 |
| 2,955,299 | 10/1960 | Ingram | 182/48 |
| 3,433,323 | 3/1969 | Ukawa | 182/48 |
| 4,473,916 | 10/1984 | Connold | 14/71.5 |

FOREIGN PATENT DOCUMENTS

| | | | |
|---|---|---|---|
| 2034649 | 6/1980 | United Kingdom | 14/71.1 |

*Primary Examiner*—Reinaldo P. Machado

*Attorney, Agent, or Firm*—Kenyon & Kenyon

[57] ABSTRACT

An escape arrangement for use on board a rig (10), platform or similar sea-based construction includes in combination a gangway construction (15, 16) and an inflatable slide (23). The gangway construction (15, 16) is in normal use adapted to form a self-supporting gangway connection between two sea-based constructions (for example between a working rig and an accommodation rig). Further it is adapted to be axially displaced and to be readjusted about a vertical and/or a horizontal axis from the one construction relative to the other construction. The slide (23) is adapted to be able to be stowed away in an inactive condition in a manner requiring little space and in an active use condition to be able to be stretched out to a relatively large length and in an easily adjustable manner relative to a moveable base, to form a regulatable component in the escape arrangement. The slide (23) is fastened to the outer end of the gangway construction and is adapted for easy readjustment from an inactive to an active position to form a free downwardly hanging, direct extension of the outer end of the gangway construction.

19 Claims, 3 Drawing Figures

ESCAPE MEANS FOR SEA-BASED CONSTRUCTION

Figure 1:
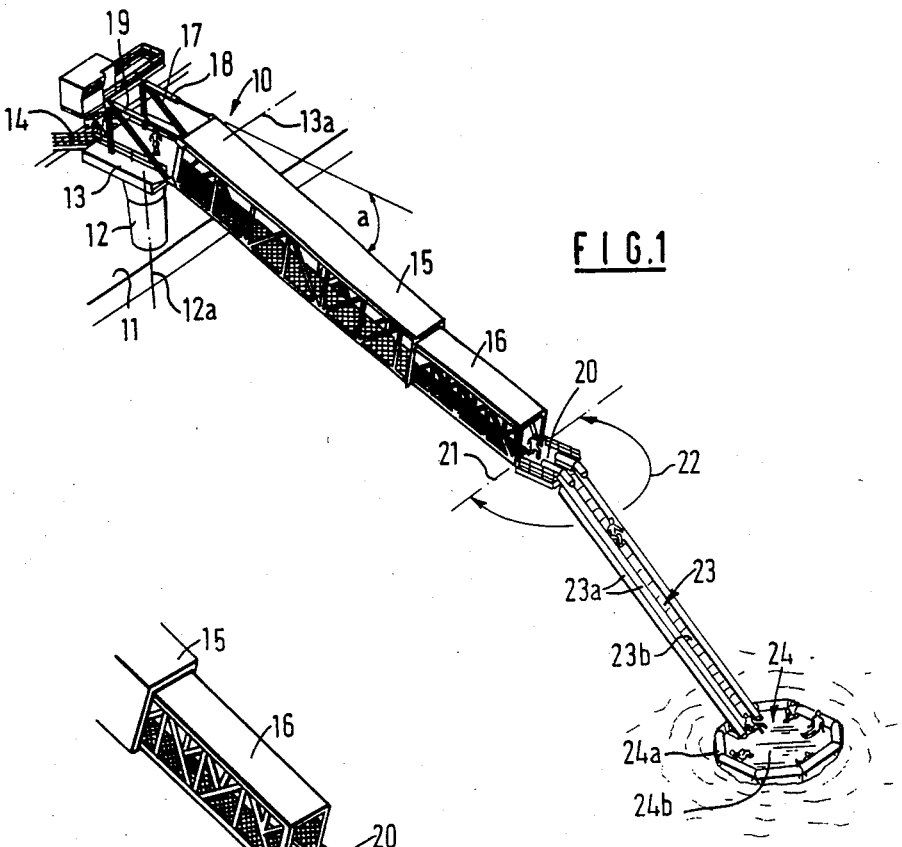

This invention relates to escape means for use on board a rig, platform or similar sea-based construction.

In a catastrophic situation on board a sea-based construction, the availability of a satisfactory escape arrangement is vital, that is to say an escape arrangement which is suited for use under particularly difficult conditions with the appearance of strong natural forces (strong winds, heavy seas) and especially with an eye to the outbreak of fire, the danger of capsizing and the like. It is also vital that the escape arrangement is readily readjustable from an inactive to an active use conditions.

With the present invention, the objective is to utilise existing arrangements on board the rig, the platform or similar construction in an effective manner in connection with the escape arrangement. More specifically, the aim is to utilise a gangway construction—which under normal conditions forms a gangway connection between two rigs or similar constructions (for example, between a working rig and an accomodation rig)—so that it can form, in the escape arrangement, a first component which is readily readjustable, stable per se and reinforced. It is customary that the gangway construction is stationarily fastened to the one rig or similar construction in an axially displaceable manner and in a pivotable manner about a horizontal as well as a vertical axis, for adjustment of the gangway construction with respect to an arbitrary base on the remaining rig or on a similar construction. With the present invention, the aim is to employ such a known gangway construction as the main component of the escape arrangement, the objective being, immediately catastrophic-like conditions occur, to readjust the gangway construction from a position between two constructions to a position projecting freely outwards over the sea, with a suitably oblique downwardly inclined path. Here there is available a main component which is well suited for the purposes of escape in a situation of catastrophy so that persons, who are to escape the rig in a safe and controlled manner and by self-help, can get access to a region outside the rig at a level below the inner end of the gangway construction.

With the present invention, there is the further objective of combining the main component with a further component so to be able to escape the outer end of the gangway construction, in a quick and uncomplicated manner, with the aid of simple means which can be adapted in a regulatable way relative to the surface of the sea or a rescue device or a boat on the sea surface.

Accordingly, the present invention resides in an escape means for use on board a sea-based installation and comprising the combination of an axially displaceable gangway means adapted in normal circumstances to provide a self-supporting connection between two sea-based installations while being readjustable about vertical and horizontal axes from one installation relative to the other, and flexible slide means adapted to be stowed away in restricted space and to be readily activated from this position to a stretched out position of relatively large length in which said slide means is freely suspended from said gangway means at its outer end and as a direct extension thereof.

It is preferred that the slide means is fastened to a platform member which can be pivoted about vertical and horizontal axes relative to the outer end of the gangway means so that the slide means can be adjustably regulated in a directional path which deviates considerably from the directional path of the gangway construction.

In consequence, it will be possible, in practice, to allow the directional path of the slide means to extend parallel to the direction of the wind or the direction of the waves thereby ensuring an easily regulatable abutment between the slide means and the sea surface (or a rescue device or a boat on the sea surface) in an elastically yielding manner.

Figure 2:
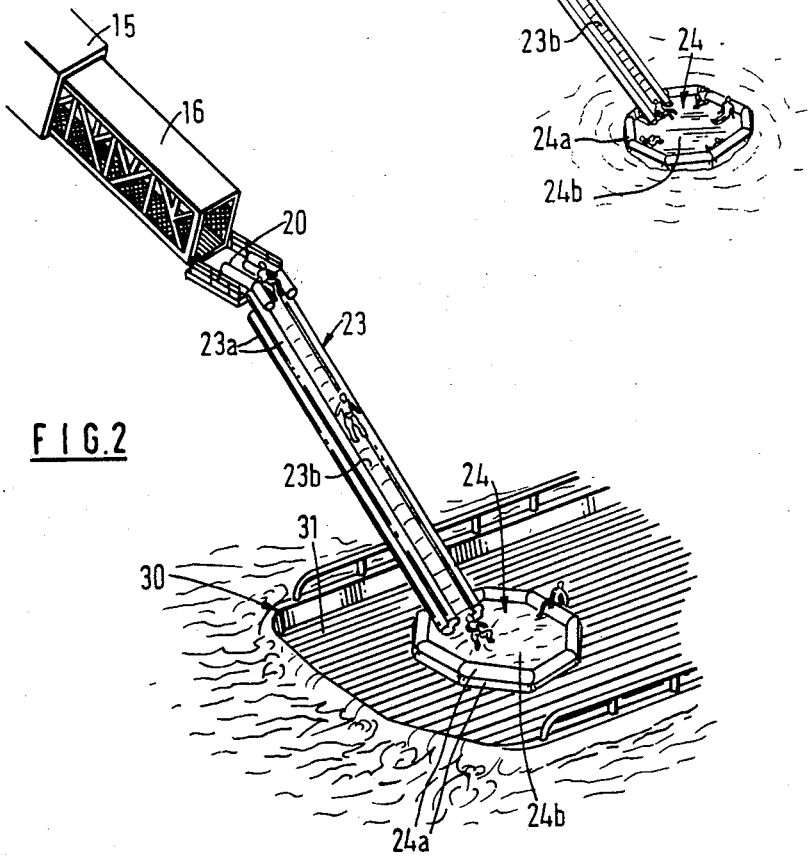
Figure 3:
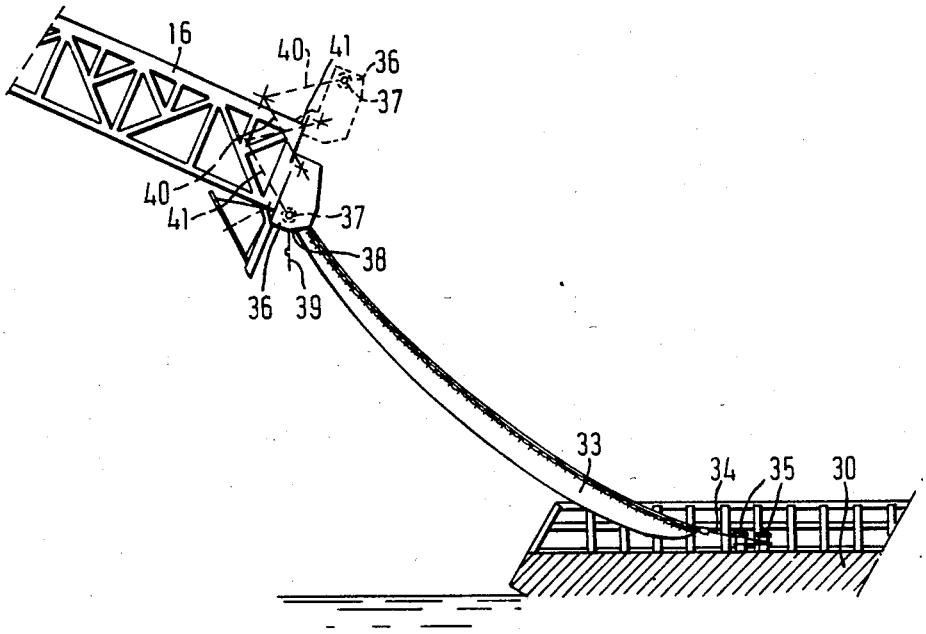

In order that the invention can be more clearly understood, convenient embodiments thereof will now be described, by way of example, with reference to the accompanying drawings in which:

FIG. 1 is a perspective representation of an escape means according to a first embodiment, illustrated in a condition ready for use, FIG. 2 is a perspective representation, on a large scale, of a portion of an escape means, and FIG. 3 is a side representation of an escape means according to a second embodiment, illustrated in a condition ready for use.

Referring to FIG. 1, there are shown portions of a rig 10 with a working deck 11. On the deck 11, there is pivotably mounted about a vertical axis 12*a*, a tower 12 with an upper landing portion 13 and associated flight of steps 14. The flight of steps can, for example, be swung together with the tower to different angular positions about the axis 12*a*.

At the opposite end of the landing portion 13, there is pivotably mounted, about a horizontal axis 13*a*, the lower edge of a gangway construction 15, 16, while the upper edge of the gangway construction 15, 16 is connected to a stand 17 via two parallel piston-cylinder arrangements 18, 19. As a result, the gangway construction 15, 16 can be adjusted into different angular positions about the horizontal axis 13*a*. The gangway construction is adjusted in a use position for escape purposes with an angle a of, for example, 16° below the horizontal plane.

The gangway construction consists of two (but can, if necessary, consist of more) telescopically collapsible elongated portions 15 and 16, respectively. The gangway construction can, consequently, be displaced axially with the outermost end of the portion 16 adjustable to different distances from the rig, as required, and to different levels above the surface of the sea, as required.

At the outer end of the portion 16, there is fastened a platform-forming gangway member 20 which can be adjusted to various angles relative to the lower edge of the gangway portion 16 about a horizontal axis 21. The member 20 is composed of two parallel parts which are mutually pivotable about a common vertical axis (not shown) so that the upper part of the gangway member 20 can be adjusted into various angular positions such as indicated by the arrow 22.

From the member 20, there extends an oblique, downwardly directed flexible slide means 23 which terminates in a rescue device 24 arranged floating on the sea. The slide means 23 and the rescue device 24 are preferably designed in one piece or at any rate designed as a coherent unit. The slide means 23 and the rescue device 24 are inflatable by means of one or more cooperating gas flasks. More specifically, the slide means is composed of a series of separately inflatable sausage-like, longitudinal strut members 23*a* and an intermediate slide-forming support member 23*b*, with, if necessary, extra sausage-like strut members (not shown) on the under side of the support member. Correspondingly, the rescue device 24 is composed of two or more sausage-like strut members 24*a* jointed together to form a ring and an intermediate base member 24*b* with, if necessary, extra sausage-like strut members (not shown) on the under side. The slide 23 is jointed above to the outer edge of the gangway member 20 and is correspondingly linked below to the rescue device 24 and is, in addition, elastically moveable between the ends. There is here available a first component 15, 16 which forms a stable, easily readjustable support construction and a second component 23, 24 which makes it possible to adapt the rescue device in an effective manner to the movements of the sea and the movements of the wind respectively.

A particular advantage of the inflatable second component 23, 24 is that it can be received in a manner requiring little space on the gangway member 20 in an inactive condition, preferably on the under side of the gangway member 20, and, for example, in a container (not shown) adapted for this purpose made ready for paying out in a rapid and ready manner.

As an alternative to the inflatable construction, there can be employed, for example, a stocking-like device extending more or less vertically downwards which below, for example, is connected to an inflatable rescue device of a type corresponding to that shown in the drawings or which can cooperate with another type of rescue device.

Another embodiment is shown in FIG. 2 in which an arrangement in connection with a boat 30 is illustrated, the rescue device 24 resting against the deck 31 of the boat and together with the boat being subjectable to considerable movements on the sea. The slide can compensate for movements between the gangway construction and the boat, at the same time as the connection between these is ensured. The rescue device can, in addition, serve as a cushioning means for persons who, via the slide, slide downwards towards the deck of the boat.

In the embodiment of FIG. 3, a slide (glide path) is shown in the form of a canvas chute 33 which with associated fastening rope 34, fastened to edge portions of the canvas chute, can be secured to bollards 35 on the deck 31 of a boat 30. At its opposite and upper end, the canvas chute is fastened to a container 36 via a drum 37. The drum 37 can be driven by a hydraulic motor (not shown) or a compressed air motor (driven by compressed air from a compressed air flask) or another suitable drive device. The canvas and associated fastening rope can be fastened to and wound up on the drum in an inactive position and can be payed out from the drum through an opening 38 which is normally covered with a closing cover 39.

In a condition ready for use shown in FIG. 3 in full lines, the container 36 is arranged just in front of the exit from the outer portion 16 of the gangway construction. In this position, the drum can be arranged on the under side of the outer portion 16 of the gangway construction, that is to say in a chamber which is defined on the under side of a platform (not shown). From the platform there can be effected an outward rising to the canvas chute, and just in front of the platform, there can be arranged a fence with associated gate (not shown).

In an inactive condition as represented in FIG. 3 by broken lines, the container 36 (with rope tackle and canvas received therein) is swung upwards to an upper position above the exit from the outer portion 16 of the gangway construction. By broken lines 40, 41, there is indicated a pair of lifting arms for pivoting the container 36 from a condition ready for use to an inactive condition and vice versa. The lifting arms can, for example, be pivoted by pneumatically or hydraulically controlled pressure cylinders.

I claim:

1. Escape means for use on board a sea-based installation and comprising the combination of an axially displaceable gangway means adapted in normal circumstances to provide a self-supporting connection between two sea-based installations while being readjustable about vertical and horizontal axes from one installation relative to the other, and an inflatable flexible slide means adapted to be stowed away in restricted space and to be readily activated from this position to a stretched out position of relatively large length in which said slide means is freely suspended from said gangway means at its outer end and as a direct extension thereof.

2. The escape means of claim 1, wherein the slide means in its stretched out position terminates in a rescue device portion adapted to float on the sea.

3. The escape means of claim 1, wherein the gangway means has at its outer end a platform member mounted to pivot about vertical and horizontal axes, said slide means being connected to said platform member to enable the direction of the path provided by said slide means to be regulatably adjusted relative to the path provided by the gangway means.

4. The escape means of claim 3, wherein the slide means is adapted to the stowed away under the platform member.

5. The escape means of claim 1, wherein the slide means comprises a chute and a line fastened to said chute, and the gangway means has mounted adjacent its outer end power-drivable drum means to which one end of said line and its associated chute are fastened to permit winding up thereon and unwinding therefrom, while the opposite end of said line is adapted to be fastened to a rescue vessel.

6. The escape means of claim 5, wherein the drum means is received in a pivotable housing from which the line and associated chute can be payed out, said housing being adapted to assume a pivoted position above the outer end of the gangway means when the chute and line are stowed away on the drum means and being adapted to assume a pivoted position in front of said outer end when the drum is to be unwound.

7. An escape apparatus comprising a gangway having a plurality of elongated portions disposed in longitudinally extendable relation to provide a self-supporting connection between two installations, said gangway being mounted for pivoting about a horizontal axis and a vertical axis; and flexible slide means mounted at one end of said gangway in a folded stowed position under said gangway for subsequent free suspension therefrom into a stretched out position.

8. An escape apparatus as set forth in claim 7 wherein said slide means is inflatable.

9. An escape apparatus as set forth in claim 7 wherein said gangway includes a platform at said end having said slide means mounted thereon, said platform being pivotally mounted relative to said sections of said gangway to pivot about a vertical axis and a horizontal axis.

10. An escape apparatus as set forth in claim 9 wherein said slide means is mounted underneath said platform.

11. An escape apparatus as set forth in claim 7 wherein said gangway includes a rotatable drum at said end and said slide means includes a chute secured at one end to said drum for winding thereon and a line fastened to said chute for winding and unwinding therewith.

12. An escape apparatus as set forth in claim 11 which further includes a housing receiving said drum therein, said housing being pivotable between a position above said end of said gangway in said stowed position of said slide means and a position in front of said end of said gangway with said slide means suspended therefrom.

13. An escape apparatus as set forth in claim 7 which further comprises a rescue device secured to a dependent end of said slide means in said stretched out position thereof.

14. An escape apparatus as set forth in claim 13 wherein each of said slide means and said rescue device is inflatable.

15. In combination, a rig having a deck;

a tower pivotally mounted on said deck about a vertical axis with a landing portion thereon;

a gangway pivotally mounted on said tower about a horizontal axis, said gangway including at least two telescopically collapsible portions for axial displacement from said rig to provide a self-supporting connection between two installations;

a platform secured to said gangway at one end thereof for pivoting about a vertical axis; and a flexible slide means secured at one end to said platform in a folded stowed position of subsequent free suspension therefrom into a stretched out position.

16. The combination as set forth in claim 15 which further comprises a rescue device secured to a dependent end of said slide means to form a cushion for a person sliding down said slide means in said stretched out position thereof.

17. The combination as set forth in claim 16 wherein each of said slide means and said rescue device is inflatable.

18. The combination as set forth in claim 15 wherein said slide means is a flexible stocking-like device.

19. The combination as set forth in claim 15 wherein said slide means is a flexible canvas chute.

* * * * *

UNITED STATES PATENT AND TRADEMARK OFFICE

CERTIFICATE OF CORRECTION

PATENT NO. : 4,602,697

DATED : July 29, 1986

INVENTOR(S) : Oscar Aanensen

It is certified that error appears in the above-identified patent and that said Letters Patent is hereby corrected as shown below:

Column 1, line 16 "condi-tions. should be condi-tion.

Column 1, line 24 "accomodation" should be -accommodation-
Column 1, line 49 "so to" should be -so as to-
Column 1, line 67 "is" (second occurrence) should be -be-
Column 2, line 61 "floating" should be -to float-
Column 3, line 34 "subjectable" should be -subject-
Column 4, line 34 "to the" should be -to be-
Column 4, line 60 "suspansion" should be -suspension-

Signed and Sealed this

Twenty-fourth Day of March, 1987

*Attest:*

DONALD J. QUIGG

*Attesting Officer*

*Commissioner of Patents and Trademarks*